US006804860B2

(12) United States Patent
Au

(10) Patent No.: US 6,804,860 B2
(45) Date of Patent: Oct. 19, 2004

(54) WIDE ANGLED HINGE FOR CONTAINER

(75) Inventor: Kinsen Ka Fai Au, Tuen Mun (HK)

(73) Assignee: Nationalpak Limited, Tuen Mun (HK)

( * ) Notice: Subject to any disclaimer, the term of this patent is extended or adjusted under 35 U.S.C. 154(b) by 0 days.

(21) Appl. No.: 10/338,970

(22) Filed: Jan. 10, 2003

(65) Prior Publication Data

US 2004/0134035 A1 Jul. 15, 2004

(51) Int. Cl.[7] ..... E05D 11/06
(52) U.S. Cl. ..... 16/357; 16/360
(58) Field of Search ..... 16/357, 360, 361

(56) References Cited

U.S. PATENT DOCUMENTS 2,567,263 A * 9/1951 Wilson ..... 16/357
6,269,521 B1 * 8/2001 Gabel ..... 16/287

* cited by examiner

*Primary Examiner*—Robert E. Pezzuto
*Assistant Examiner*—Tara L. Mayo
(74) *Attorney, Agent, or Firm*—Raymond Y. Chan; David and Raymond Patent Group

(57) ABSTRACT

A container includes a container body which includes a base and a plurality of side walls peripherally and upwardly extended from the base to define a storage cavity, a container cover adapted to selectively cover the storage cavity, and one or more wide angled hinges. Each of the wide angled hinges includes a primary jointing frame and a secondary jointing frame to enable the container cover being moved between an opened position and a closed position. In the opened position, the primary jointing frame and the secondary jointing frame are pivotally moved and extended to open pivotally move the container cover away from the container body to form a wide opening angle with respect to horizontal. In the closed position, the primary joint frame and the secondary jointing frame are pivotally moved to receive in the storage cavity through the sliding slot so as to pivotally move the container cover to close the storage cavity.

19 Claims, 4 Drawing Sheets

WIDE ANGLED HINGE FOR CONTAINER

BACKGROUND OF THE PRESENT INVENTION

1. Field of Invention

The present invention relates to hinges, and more particularly to a wide angled hinge which, when used in a container, enables a cover of the container to be opened and maintained in a wide variety of angles with respect to a container body of the container.

2. Description of Related Arts

Nowadays, various kinds of container are used for a variety of purposes. For example, they are used for temporary storage, displaying the objects which are stored in the containers, protecting the objects stored in the containers from being touched or accessed by unauthorized persons, and the likes.

Whatever their functions, a conventional container usually comprises a container body, a cover, and a hinge mounted on the container body and the container cover for connecting the container body and the container cover in a pivotally movable manner.

The container body comprises a bottom and a plurality of container walls upwardly and peripherally extended therefrom to define a storage cavity within the bottom and the container walls. The container cover, as it name implies, is usually shaped and sized to fittedly cover the storage cavity of the container body so as to physically isolate the objects stored in the storage cavity from outside. The hinge usually comprises first and second connecting members securely connected to respective outer sides of the container body and the container cover. The first and the second connecting members are pivotally connected with each other in such a manner that they are capable of pivotally of moving at a predetermined range with respect to each other so as to pivotally open and close the container cover with respect to the container body. The extent to which the container cover is opened with respect to the container body depends on the range of lateral pivotal movement of the first and the second connecting members.

Ostensible disadvantages can be derived from such conventional containers and their conventional hinging arrangements between the container cover and the container body. First, it is justifiable to say that conventional containers lack flexibility, although in some circumstances, such flexibility plays minimal role. As a matter of fact, almost all conventional containers only allow their respective cover to be either fully opened or closed, with no self-induced mechanism in maintaining them in between. And, very often, in the fully opened position, the container cover is usually pivotally moved to an extent that makes an inclination 180° or more with horizontal to induce unsatisfactory or undesirable degree of opening of the container.

If the container was only intended to store some objects and no more, it would have no problem. However, it will not be the case if the container is used, for example, for displaying purpose. In such circumstances, the container cover may need to be opened partially and therefore maintained in an elevated position between the fully opened position and the fully closed position. It is impossible until some external measures, such as adding a support, are introduced.

Thus, some 'improved' containers have really been developed. Besides the elements as described in the above mentioned conventional container, it further comprises a pair of supporting frames attached on the container body and operatively connected with the container cover in such a manner that they are capable of selectively supporting the container cover in an elevated position between the fully opened position and the fully closed position. Ironically, with the induction of the supporting frames, many of the container covers are restricted by them in the sense that they can only be opened to be perpendicular to the horizontal. Thus, in reality, their ability of maintaining in an elevated position is traded against a reduction in their range of opening.

Secondly, in conjunction with the inflexibility that conventional containers possess, in some circumstances, it would be inconvenient even for the user of the container to place and to take the objects in and away the container. This is especially true in case of a container which is specifically designed for storing watch in which a watch holder is usually utilized to support the watch. The problem here does not lie with the watch holder, it may be that the watch which is inconvenient, if not difficult, to be securely placed into the container, and specifically, on the watch holder, because the container is not optimally, or adequately opened.

Actually, most conventional jewelry box can only allow its cover to be opened perpendicularly with the horizontal in order to prevent the whole box, when fully opened, from flipping over because of unbalanced weights between the container body and the container cover. However, it is this unpleasant feature which makes the conventional jewelry box unsatisfactory. Sometimes, the jewelry stored inside the box may need to be shown to other people, and one may find that he/she is unable to do so because the box cannot to fully be opened to the extent that people in the vicinity of the box can clearly see the jewelry, this is especially true for those standing at the back or even at two sides of the jewelry box.

Thirdly, if the container, as mentioned above, was aimed for displaying purpose, such as that of a jewelry container, it would be unpleasant for the hinge to be exposed on the outer side of the container. Furthermore, the fact that the conventional hinges are almost completely made of metal means that may cause potential danger to other peoples. In some circumstances, the sharp edges of the hinge exposed outside the container may scratch and hurt somebody.

Finally, almost most conventional containers merely allow their covers to be opened by pivotally rotating about a top edge of the container body where the hinges are attached. Accordingly, they are generally 'inseparable' from the container body in the sense that an edge of the container cover is pivotally connected with the top edge of the container body. In some circumstances, this feature possesses considerable inconvenience for the user.

SUMMARY OF THE PRESENT INVENTION

A main object of the present invention is to provide a wide angled hinge for a container which allows a cover of the container to be opened and kept at a wide variety of angles without flipping over because of weights' unbalance.

Another object of the present invention is to provide a wide angled hinge for a container wherein the hinge is arranged to be received in the container so that when the container cover of the container is closed, the hinge will not be exposed to outside of the container.

Another object of the present invention is to provide a wide angled hinge for a container which neither involves any complicated mechanical structures nor alter the original structure of the container so as to minimize the manufacturing and related costs of the present invention.

Another object of the present invention is to provide a wide angled hinge for a container which is capable of facilitating optimal opening of the container so as to meet differing requirements in different circumstances.

Another object of the present invention is to provide a container comprising a wide angled hinge which facilitates a cover of the container to be pivotally opened and kept at a variety of predetermined positions so as to maximize the flexibility of the container.

Accordingly, in order to accomplish the above objects, the present invention provides a container, comprising:

a container body which comprises a base and a plurality of side walls peripherally and upwardly extended from said base to define a storage cavity surrounded by said side walls, wherein one of said side walls has one or more sliding slots for communicating said storage cavity and outside of said container;

a container cover adapted to selectively enclose said storage cavity; and one or more wide angled hinges for connecting the container cover with the container body to selectively cover the container body, wherein each of the wide angled hinges comprises:

a primary jointing frame, comprising:

a base member which has a securing portion mounted on said base of said container body and a free end portion longitudinally extended from the securing portion; and a primary connecting member, which has a lower supporting portion pivotally connected to the free end portion of the base member and an upper end portion securely mounted on a bottom surface of the container cover; and a secondary jointing frame, comprising:

a hinging member which has a pivotal portion pivotally connected with said securing portion of said base member and a hinging end longitudinally extended from the pivotal portion; and a secondary connecting member, which has a first coupling end pivotally connected with the hinging end of the hinging member, and a second coupling end operatively connected with the upper end portion of the primary connecting member in such a manner that the primary connecting member and the secondary connecting member are capable of sliding through the respective sliding slot of the side wall so as to pivotally and selectively operate the container cover with respect to the container body for opening or closing the container.

DETAILED DESCRIPTION OF THE PREFERRED EMBODIMENT

Figure 1:
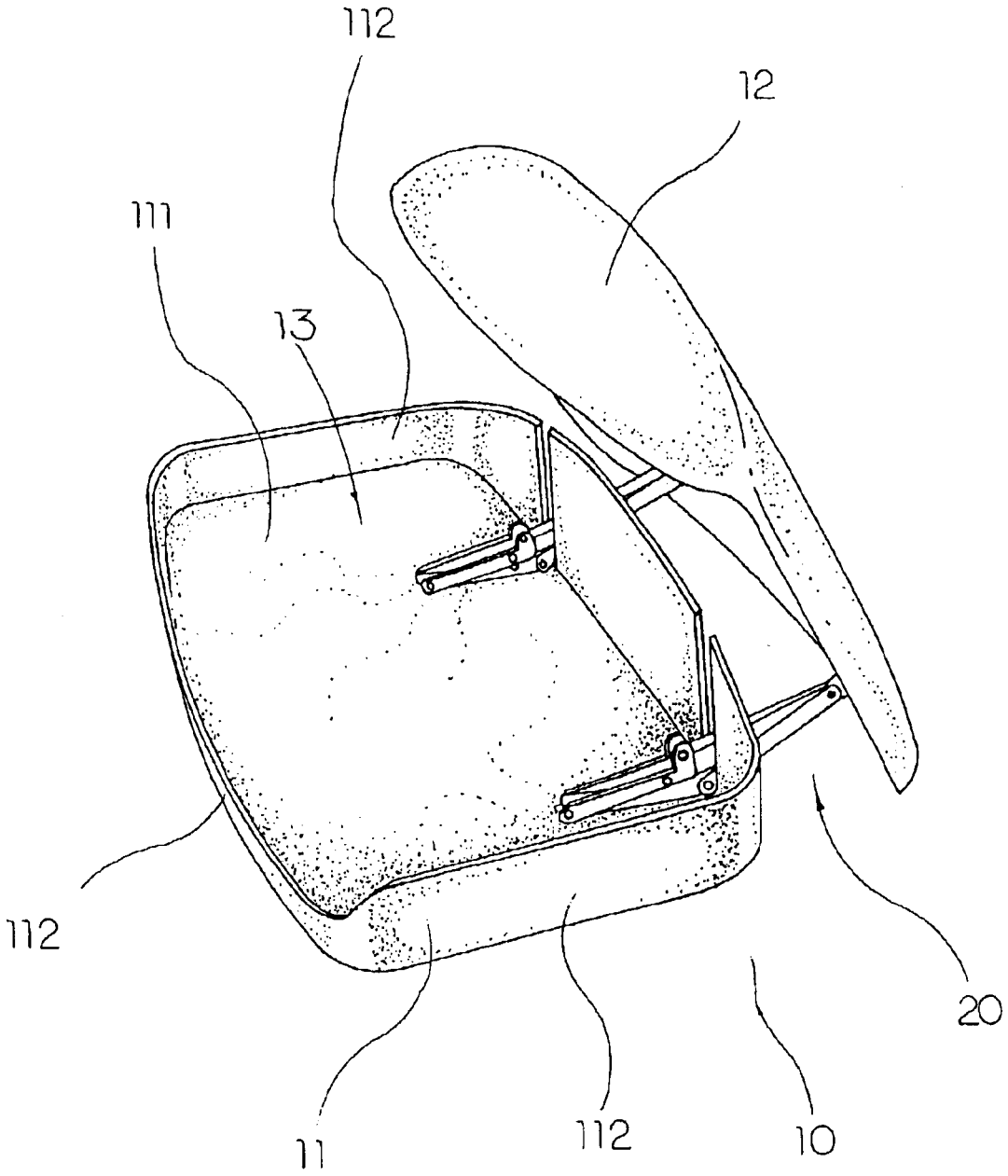
FIG. 1 is a perspective view of a container incorporated with a pair of wide angled hinges according to a preferred embodiment of the present invention.

As shown in FIG. 1 of the drawings, a container 10 incorporated with a plurality of wide angled hinges 20 according to a preferred embodiment of the present invention is illustrated, wherein the container 10 comprises a container body 11, a container cover 12 operatively provided thereon, and one or more wide angled hinges 20.

The container body 11 comprises a base 111 having a square or rectangular shape and four side edges and four side walls 112 upwardly and peripherally extended from the four side edges respectively to form a surrounding wall to define a storage cavity 13 in the container body 11 surrounded by the side walls 112.

The container cover 12 is shaped and sized to fittedly and selectively cover the storage cavity 13 and arranged to be operated between a closed position and an opened position, wherein in the closed position, the container cover 12 is pivotally operated to completely cover and enclose the storage cavity 13 of the container body so as to close the container 10 of the present invention, wherein in the opened position, the container cover 12 is pivotally moved to an inclination position with respect to the horizontal so as to open the storage cavity 13 on top.

Figure 2:
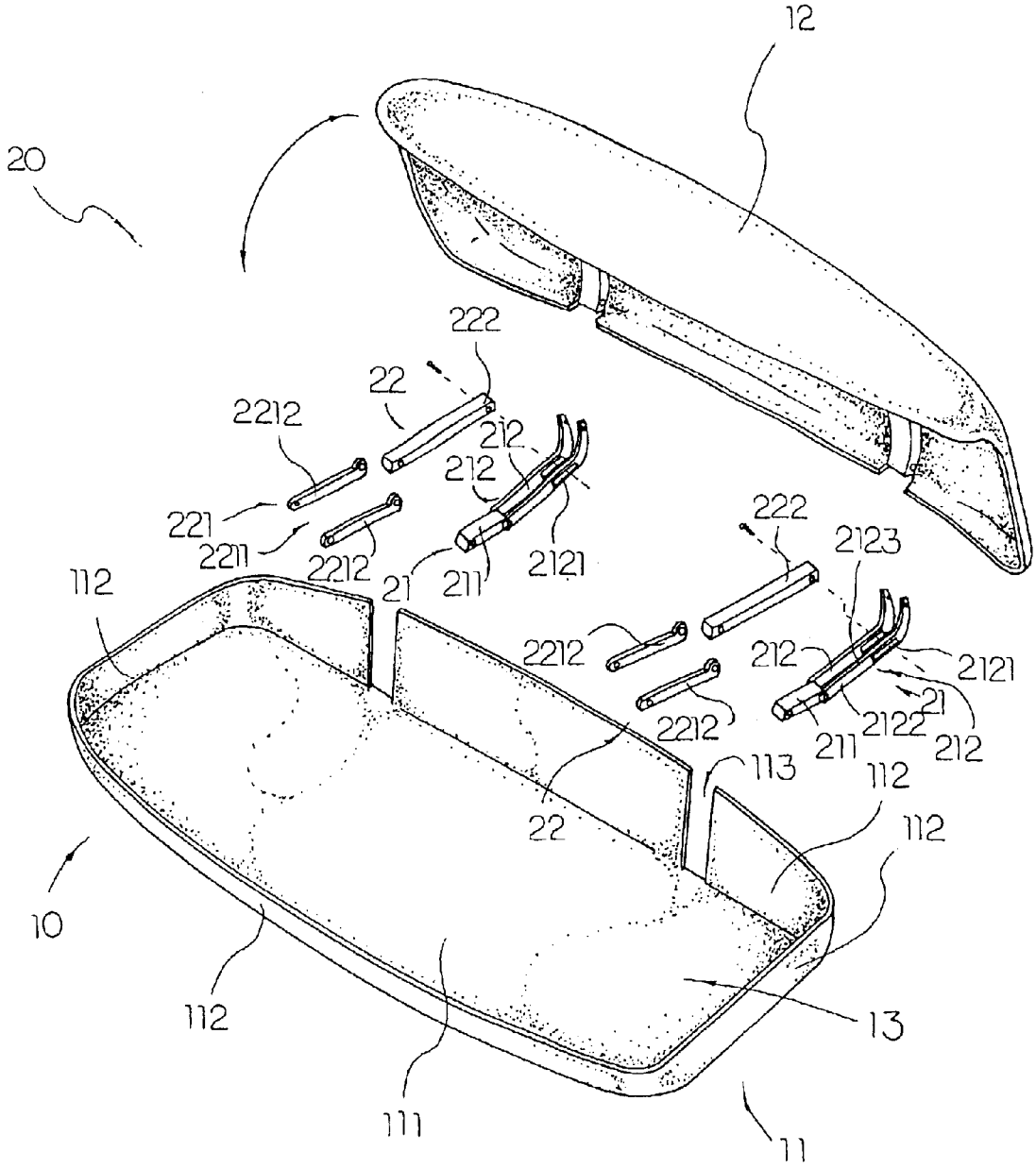
FIG. 2 is an exploded perspective view of the container incorporated with the pair of wide angled hinges according to the above preferred embodiment of the present invention.

Referring to FIGS. 1 to 2 of the drawings, each of the wide angled hinges 20 comprises a primary jointing frame 21 and a secondary jointing frame 22. The primary jointing frame 21 comprises a base member 211 having a securing portion mounted on an upper surface of the base 111 of the container body 11 and a free end portion longitudinally extended from the securing portion, and a primary connecting member 212 having a lower supporting portion pivotally mounted on the free end portion of the base member 211 and an upper end portion mounted on a bottom surface of the container cover 12.

In order to incorporate the wide angled hinges 20 with the container 10, the container body 11 further has one or more sliding slots vertically 113 formed on the first side wall 112 in such a manner that the storage cavity 13 is capable of communicating with outside of the container 10 via the sliding slots 113.

The secondary jointing frame 22 comprises a hinging member 221 which has a pivotal portion pivotally mounted on the securing portion of the base member 211 and a hinging end extended from the pivotal portion. The secondary jointing frame 22 further comprises a secondary connecting member 222, which has first coupling end pivotally connected with the hinging end of the hinging member 221 and a second coupling end operatively connected with the upper end portion of the primary connecting member 212 in such a manner that the primary connecting member 212 and the secondary connecting member 222 are capable of sliding at the sliding slot 113 of the first side wall 112 so as to pivotally and selectively operate the container cover 12 with respect to the container body 11 for opening or closing the container 10.

According to the preferred embodiment of the present invention, the primary connecting member 212 has a connecting slot 2121 formed on the upper end portion wherein the second coupling end of the secondary connecting member 222 is operatively connected to the connecting slot in a pivotally and slidably movable manner. In other words, the second coupling end of the secondary connecting member 222 is pivotally and slidably connected to the upper end portion of the primary connecting member 212 so as to pivotally move the container cover 12 with respect to the container body 11.

Furthermore, the hinging member 221 further has a receiving channel 2211 formed therein, wherein the base member 211 of the primary jointing frame 21 is adapted to be received in the receiving channel 2211 when the hinging member 221 is pivotally moved to open and close the container cover 12. Accordingly, the hinging member 221 comprises a pair of hinging arms 2212 each has the pivotal portion pivotally connected with the securing portion of the base member 211 and the hinging end pivotally connected to the first coupling end of the secondary connecting member 222 so as to define the receiving channel between the hinging arms 2212.

Similarly, the primary connecting member 212 further has a folding channel 2122 formed thereon wherein the secondary connecting member 222 is adapted to be received in the folding channel 2122 for pivotally opening the container cover 12 with respect to the container body 11. According to the preferred embodiment, the primary connecting member 212 comprises a pair of folding arms 2123 each has the lower supporting portion pivotally connected the free end portion of the base member 211, and the upper end portion securely connected to the bottom surface of the container cover 12 to form the folding channel 2122 between the pair of folding arms 2123. Accordingly, the secondary connecting member 222 is adapted to be received in the folding channel 2122 so as to fully open the container cover 12 to the opened position.

It is worth mentioning that, any alternative method in forming the receiving channel 2211 may also be used, provided that the base member 211 can be received in the receiving channel 2211 so that hinging member 221 can be pivotally moved to close the container cover 12 to the closed position.

The hinging member 221 of the secondary jointing member 22 is designed and crafted to be 'L' in shaped with its hinging end transversely and integrally extended from the pivotal portion and pivotally connected with the first coupling end of the secondary connecting member 222.

Figure 3A:
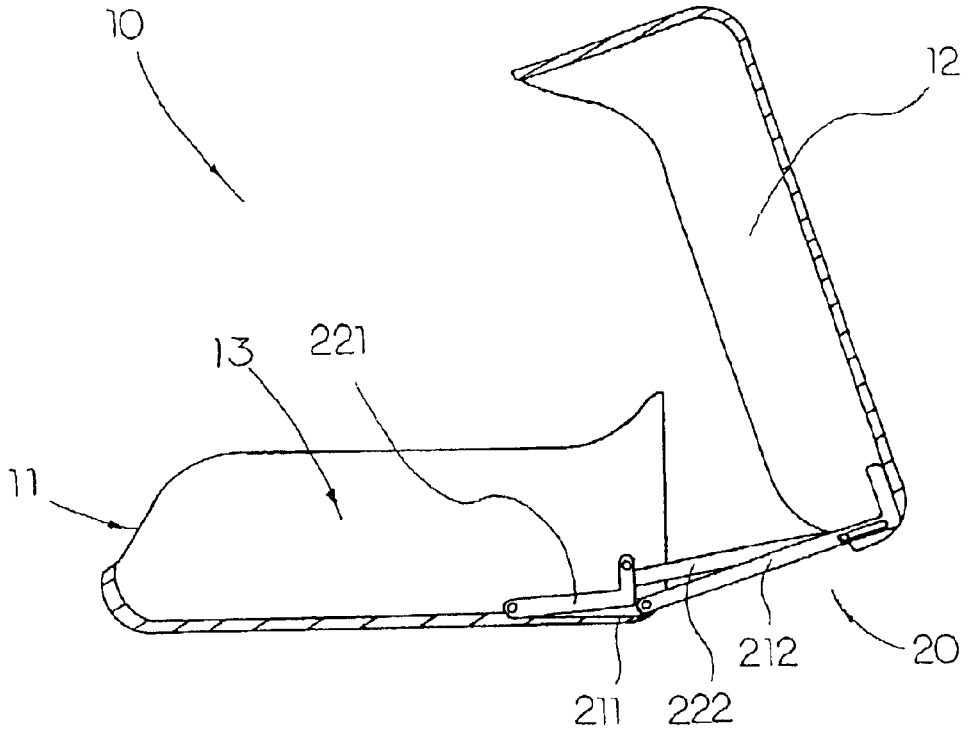
FIGS. 3A to 3C are sectional side view of the container incorporated with the pair of wide angled hinges according to the above preferred embodiment of the present invention, illustrating that the container cover is, respectively, in the opened and closed position.
Figure 3B:
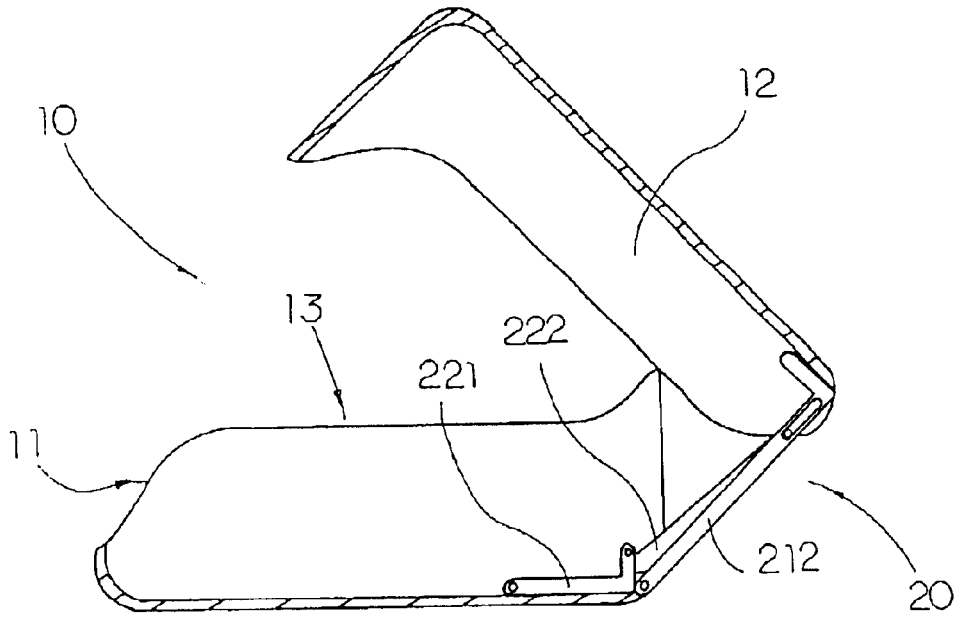
Figure 3C:
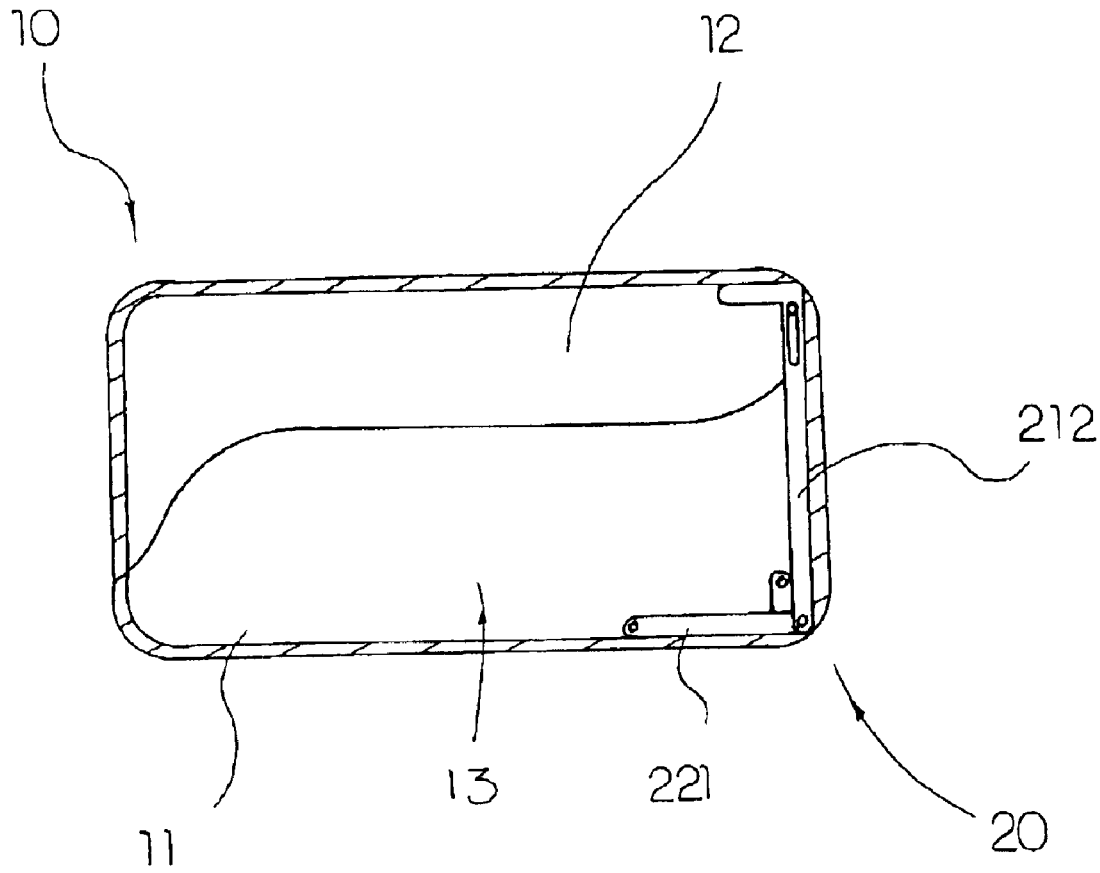

As shown in FIGS. 3A through 3C of the drawings, when the container cover 12 is in the opened position, the primary connecting member 212 is pivotally moved and extended about the free end portion of the base member 211 so as to maximize the opening angle with the horizontal and to fully open the container cover 12. At the same time, the secondary connecting member 222 is also pivotally moved and extended in such a manner that it tends to pivotally move to coincide with the primary connecting member 212 respectively, with the secondary connecting arm 222 substantially received in the receiving channel 2211, and that the second coupling end of the secondary connecting member 222 slid backwardly with respect to the connecting slot 2121. On the other hand, the hinging member 221 is pivotally lifted up to move away from the folding channel 2122 for opening the container cover 12. Worth mentioning is that when the container cover 12 is being opened, the primary and the secondary jointing frames 21, 22 are sliding downwardly with respect to the sliding slot 113 formed in the first side wall 112, wherein the first and the second connecting members 221, 222 are pivotally moved away from the container body 11 through the sliding slot 133. The result of the above actions is that the container cover 12 is pivotally opened to the opened position, allowing the storage cavity 13 to be communicated with outside of the container 10 of the present invention.

As shown in FIG. 3B of the drawings, when the container cover 12 is about to close, the primary connecting member 212 is pivotally moved towards the container body 11 about the base member 211, whereas the hinging member 221 is pivotally folded to coincide with the base member 211 about the securing portion of the base member 211 to which it is pivotally connected. At the same time, the secondary connecting member 222 is pivotally folded towards the container body 11 about the hinging end of the hinging member 221, with the second coupling end slide forwardly in the connecting slot 2121 with respect to the primary connecting member 212. The result of the above actions is that the container cover 12 is pivotally moved towards the container body 11. It is worth mentioning that when the container cover 12 is being closed, the primary and the secondary connecting members 21, 22 are pivotally moved towards the container body 11 through the sliding slots 113.

As shown in FIG. 3C of the drawings, when the container cover 12 is closed in the closed position, the primary and the secondary connecting member 212, 222 are further folded pivotally about respectively, the free end portion of the based member 211 and the hinging end of the hinging member 221, and to vertically receive in the storage cavity 13 of the container body 11 through the sliding slot 133. At the same time, the hinging member 221 is pivotally moved downwardly to coincide with the base member 211, with the base member 211 substantially received in the receiving channel 2211 of the hinging member 221 and that the second coupling end of the secondary connecting member 222 moved forwardly in the connecting slot 2121. At the same time, the second connecting member 222 is substantially received in the folding channel 2122 formed on the primary connecting member 212. The effect of the above actions is that the container cover 12 is pivotally moved to substantially cover the container body 11 to enclose the storage cavity 13.

In other words, the container cover 12 is capable of pivotally and selectively moving between the closed position and the opened position, wherein in the opened position, the container cover 12 is opened at a wide angle with respect to the horizontal so as to allow a user to conveniently place an object in the storage cavity 13. Afterwards, the user can simply close the container cover 12 and block access to the object from outsiders.

It is worth mentioning that the wide angled hinge 20 ought to be suitable for a wide variety of containers 10. As long as the container 10 comprises a cover 12, such as the preferred embodiment, it can be incorporated with the wide angled hinges 20 in order to facilitate wide angled opening of the container cover 12 with respect to the container body 11.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A container, comprising:

a container body having a storage cavity surrounded by a surrounding wall, wherein a side of said surrounding wall has one or more sliding slots provided therein for communicating said storage cavity with outside;

a container cover adapted to selectively enclose said storage cavity; and one or more wide angled hinges for connecting said container cover with said container body to selectively cover said container body, wherein each of said wide angled hinges comprises:

a primary jointing frame, comprising:

a base member which has a securing portion mounted on said base of said container body and a free end portion longitudinally extended from said securing portion; and a primary connecting member, which has a lower supporting portion pivotally connected to said free end portion of said base member, and an upper end portion securely mounted on a bottom surface of said container cover; and a secondary jointing frame, comprising:

a hinging member which has a pivotal portion pivotally connected with said securing portion of said base member and a hinging end longitudinally extended from said pivotal portion; and a secondary connecting member, which has a first coupling end pivotally connected with said hinging end of said hinging member, and a second coupling end operatively connected with said upper end portion of said primary connecting member in such a manner that said primary connecting member and secondary connecting member are capable of sliding through said respective sliding slot of said side wall so as to pivotally and selectively operate said container cover with respect to said container body for opening or closing said container;

whereby said container cover is adapted to move between an opened position and a closed position, wherein in said opened position, said primary jointing frame and said secondary jointing frame are pivotally moved and extended to open pivotally move said container cover away from said container body, wherein in said closed position, said primary joint frame and said secondary jointing frame are pivotally moved to receive in said storage cavity through said sliding slot so as to pivotally move said container cover to close said storage cavity.

2. The container, as recited in claim 1, wherein said primary connecting member further has a connecting slot formed on said upper end portion and said second coupling end of said secondary connecting member is operatively connected to said connecting slot in a pivotally and slidably movable manner with respect to said connecting slot.

3. The container, as recited in claim 2, wherein said hinging member further has a receiving channel formed thereon and said base member of said primary jointing frame is adapted to be received in said receiving channel when said hinging member said is pivotally moved to open or close said container cover.

4. The container, as recited in claim 3, wherein said primary connecting member further has a folding channel formed thereon wherein said secondary connecting member is adapted to be received in said folding channel for pivotally opening said container cover with respect to said container body.

5. The container, as recited in claim 4, wherein said hinging member comprises a pair of hinging arms, each of which has said pivotal portion pivotally connected with said securing portion of said base member and said hinging end pivotally connected to said first coupling end of said secondary connecting member so as to define said receiving channel between said hinging arms.

6. The container, as recited in claim 5, wherein said primary connecting member comprises a pair of folding arms, each of which has said lower supporting portion pivotally connected with said free end portion of said base member and said upper end portion securely connected to said bottom surface of said container cover to form said folding channel between said pair of folding arms.

7. The container, as recited in claim 6, wherein said hinging member of said secondary jointing frame is made to be L in shaped with said hinging end transversely and integrally extended from said pivotal portion and pivotally connected with said first coupling end of said secondary connecting member.

8. The container, as recited in claim 3, wherein said hinging member comprises a pair of hinging arms, each of which has said pivotal portion pivotally connected with said securing portion of said base member and said hinging end pivotally connected to said first coupling end of said secondary connecting member so as to define said receiving channel between said hinging arms.

9. The container, as recited in claim 8, wherein said primary connecting member comprises a pair of folding arms, each of which has said lower supporting portion pivotally connected with said free end portion of said base member and said upper end portion securely connected to said bottom surface of said container cover to form said folding channel between said pair of folding arms.

10. The container, as recited in claim 9, wherein said hinging member of said secondary jointing frame is made to be L in shaped with said hinging end transversely and integrally extended from said pivotal portion and pivotally connected with said first coupling end of said secondary connecting member.

11. A wide angled hinge for a container which comprises a container body having a storage cavity surrounded by a surrounding wall which has at least a sliding slot provided at a side of the surrounding wall for communicating the storage cavity with outside and a container cover connecting with the container body for selectively enclose the storage cavity, wherein said wide angled hinge comprises:

a primary jointing frame which comprises:

a base member which has a securing portion mounted on the base of the container body and a free end portion longitudinally extended from said securing portion; and a primary connecting member, which has a lower supporting portion pivotally connected to said free end portion of said base member, and an upper end portion securely mounted on a bottom surface the said container cover, wherein said primary connecting member further has a connecting slot formed on said upper end portion; and a secondary jointing frame, comprising:

a hinging member which has a pivotal portion pivotally connected with said securing portion of said base member and a hinging end longitudinally extended from said pivotal portion; and a secondary connecting member, which has a first coupling end pivotally connected with said hinging end of said hinging member, and a second coupling end operatively connected with said upper end portion of said primary connecting member;

whereby said primary connecting member and secondary connecting member are capable of sliding through the sliding slot so as to pivotally and selectively operate the container cover with respect to the container body, so that the container cover is adapted to be moved between an opened position and a closed position, wherein in the opened position, said primary jointing frame and said secondary jointing frame are pivotally moved and extended to open pivotally move the container cover away from the container body, wherein in said closed position, said primary joint frame and said secondary jointing frame are pivotally moved to receive in the storage cavity through the sliding slot so as to pivotally move the container cover to close the storage cavity.

12. The wide angled hinge, as recited in claim 11, wherein said hinging member further has a receiving channel formed thereon and said base member of said primary jointing frame is adapted to be received in said receiving channel when said hinging member is pivotally moved.

13. The wide angled hinge, as recited in claim 12, wherein said primary connecting member further has a folding channel formed thereon wherein said secondary connecting member is adapted to be received in said folding channel.

14. The wide angled hinge, as recited in claim 13, wherein said hinging member comprises a pair of hinging arms, each of which has said pivotal portion pivotally connected with said securing portion of said base member and said hinging end pivotally connected to said first coupling end of said secondary connecting member so as to define said receiving channel between said hinging arms.

15. The wide angled hinge, as recited in claim 14, wherein said primary connecting member comprises a pair of folding arms, each of which has said lower supporting portion pivotally connected with said free end portion of said base member and said upper end portion securely connected to the bottom surface of the container cover to form said folding channel between said pair of folding arms.

16. The wide angled hinge, as recited in claim 15, wherein said hinging ember of said secondary jointing frame is made to be L in shaped with said hinging end transversely and integrally extended from said pivotal portion and pivotally connected with said first coupling end of said secondary connecting member.

17. The wide angled hinge, as recited in claim 12, wherein said hinging member comprises a pair of hinging arms, each of which has said pivotal portion pivotally connected with said securing portion of said base member and said hinging end pivotally connected to said first coupling end of said secondary connecting member so as to define said receiving channel between said hinging arms.

18. The wide angled hinge, as recited in claim 17, wherein said primary connecting member comprises a pair of folding arms, each of which has said lower supporting portion pivotally connected with said free end portion of said base member and said upper end portion securely connected to the bottom surface of the container cover to form said folding channel between said pair of folding arms.

19. The wide angled hinges, as recited in claim 18, wherein said hinging member of said secondary jointing frame is made to be L in shaped with said hinging end transversely and integrally extended from said pivotal portion and pivotally connected with said first coupling end of said secondary connecting member.

* * * * *